United States Patent [19]

Forbes, Jr.

[11] Patent Number: 4,589,619

[45] Date of Patent: May 20, 1986

[54] FOOD HOLDER

[75] Inventor: Hampton E. Forbes, Jr., Wilmington, Del.

[73] Assignee: Westvaco Corporation, New York, N.Y.

[21] Appl. No.: 580,130

[22] Filed: Feb. 14, 1984

Related U.S. Application Data

[63] Continuation-in-part of Ser. No. 511,101, Jul. 6, 1983, abandoned.

[51] Int. Cl.[4] ..... A47J 43/00

[52] U.S. Cl. ..... 248/174; D7/76; D1/102; D1/105; 248/152; 426/132; 229/DIG. 13; D9/455

[58] Field of Search ..... 248/152, 174; 426/132; 229/DIG. 13, 8; D7/76; D1/102, 105; D9/455; D2/252, 253, 254, 256; 2/197, 195

[56] References Cited

U.S. PATENT DOCUMENTS

| | | | |
|---|---|---|---|
| 1,090,142 | 3/1914 | Fischer | 248/174 |
| 1,103,091 | 7/1914 | Smith | 206/820 |
| 1,250,937 | 12/1917 | Achert | 248/174 |
| 1,252,073 | 1/1918 | Achert | 248/174 |
| 1,284,260 | 11/1918 | Doering et al. | 248/174 |
| 1,428,223 | 9/1922 | Fairbanks | 248/174 |
| 1,480,681 | 1/1924 | Goes | 248/174 |
| 1,687,616 | 10/1928 | Huye | 248/174 |
| 1,708,792 | 4/1929 | Huye | 248/174 |
| 1,866,317 | 7/1932 | Miner | 229/43 |
| 1,946,554 | 2/1934 | Sutherland | 229/43 |
| 2,063,328 | 12/1936 | Morcom | 248/152 |
| 2,116,647 | 5/1938 | Snelling | 248/152 |
| 2,203,697 | 6/1940 | Rinkel . | |
| 2,525,268 | 10/1950 | Napier | 229/31 R |
| 3,003,207 | 10/1961 | Powers . | |
| 3,017,063 | 1/1962 | Rooney | 229/68 R |
| 3,032,254 | 5/1962 | Wilson | 229/8 |
| 3,355,082 | 11/1967 | Wood . | |
| 3,446,416 | 5/1969 | Epstein . | |
| 3,610,512 | 10/1971 | Hermalin . | |
| 4,055,670 | 10/1977 | Belmont | 426/119 |
| 4,284,205 | 8/1981 | Hirata | 229/41 D |

FOREIGN PATENT DOCUMENTS

| | | | |
|---|---|---|---|
| 603337 | 8/1925 | France | 248/174 |
| 269473 | 9/1927 | United Kingdom | 248/174 |

*Primary Examiner*—Steven Weinstein

[57] ABSTRACT

The food holder of the present invention is prepared from a foldable material such as paperboard or the like in the form of an open ended sleeve. The sleeve is made from a single blank of material and comprises a central panel and a pair of end panels which overlap and are adhered together to form the sleeve. The end panels extend outwardly and upwardly with respect to the central panel and are joined to the central panel along upwardly converging fold lines. The sleeve is normally disposed in a flattened condition prior to use. When opened to accept a food product, the sleeve assumes a generally elliptical cross sectional shape with inclined ends and a top opening that is smaller than its bottom opening. Each inclined end includes an integral lock for maintaining the sleeve in its open condition.

6 Claims, 6 Drawing Figures

FOOD HOLDER

This application is a Continuation-In-Part of applicant's prior application Ser. No. 511,101, filed July 6, 1983, now abandoned.

BACKGROUND OF INVENTION

The present invention relates to a container for food products and more particularly to a paperboard container which enables the food product to be handled in a sanitary and convenient fashion. In its preferred embodiment, the container of the present invention is designed for holding Pita bread, which in its most common form is a folded over or hollowed out loaf of bread into which one places salad or other filling materials.

The container disclosed herein is designed primarily for the carryout, fast food business although it could readily find utility in the home or at picnics or other places where food products are eaten by hand. The growth in recent years of the fast food industry has created a great demand for containers for holding, packaging and otherwise enclosing food products for take out or on premises consumption. A significant advantage of such containers lies in the convenience they provide the consumer for permitting consumption directly from the container and later easy disposal of the used container. The vast variety of food products currently being marketed virtually prohibits the use of a universal container for packaging all kinds of products, thus custom made containers are required for the different products.

It is known, for instance, to provide various styles of hand held containers or sandwich holders for the most common carryout products such as hamburgers, cheeseburgers and roast beef sandwiches. The following prior U.S. Pat. Nos. show several different designs for sandwich holders; 3,003,207; 3,355,082; 3,446,416; and 3,610,512. Nevertheless, none of the prior art style containers have been found to be particularly satisfactory with the food products intended for the container of the present invention.

Pita bread is a typical product found in Greek restaurants and carryout stands. The bread is generally baked as a round, flat loaf. The loaf is cut or torn in half, and the two halves hollowed out to provide space wherein the consumer may put salad or other fillings to make a tasty and convenient hand held food product. In the past, the consumer has been required to hold the hollowed out loaf of Pita bread in one hand while filling it with the other. This procedure has contributed to unsanitary conditions and hazardous spills of filling materials, juices and condiments.

Thus, in order to overcome these inconveniences, the container of the present invention was developed to provide the consumer with a reliable, safe and sanitary food holder for Pita bread or the like.

SUMMARY OF INVENTION

The present invention is devoted to a food holder prepared from a single blank of paperboard or the like which is manufactured and shipped in a flattened condition, but which may be squared for use to form an elliptically shaped construction with tapered ends. The blanks which are used to form the food holding device may be partially nested during manufacture where they are cut and scored to provide a unique shape. For this purpose, the blanks are provided with a central portion and a pair of angulated wing portions or end panels which are separated from the central portion by a pair of inclined score lines. The central portion and wing portions are generally of about the same height with straight upper edges and curved bottom edges of the same radius. The combined length of the end planels is slightly greater tha the length of the central panel between its opposed ends. One of the wing portions is shaped at its end to provide a glue area which is adhered to the end of the other wing portion during manufacture to provide an open ended sleeve. In effect, the central portion forms one side of the sleeve and the two wing portions when adhered together form an identical and opposite side of the sleeve. When the sleeve element is squared for use, it assumes the general shape of an ellipse with tapered ends formed by the inclined score lines. Moreover, because the end scores are inclined so as to converge in an upward direction, the base opening is larger than the top opening to provide a stable platform for holding the desired food product, i.e., a Pita bread sandwich.

The desired shape of the food holder is achieved by cutting the blank so that the bottom edge of the blank is curved while the upper edge of each blank portion is straight. Further, the blank portions are defined by applying each blank with two inclined scores. Finally, the food holder is formed with two folding steps wherein the ends of the wing portions are folded to overlap one another where they are glued together. The angle of inclination of the score lines from the vertical is substantially equal to the angle of inclination of the straight upper edges of the end panels from the horizontal to achieve a structure wherein the ends of the wings are aligned with one another when they are overlapped. The blanks are further provided with integral locking means formed along each inclined score line wherein the food holder may be locked in its open condition.

After manufacture, the formed blanks may be shipped to the user in a flattened condition. At the point of use, the tapered nature of the opened food holders is such that they may be nested and stacked in a compact manner for use by the consumer. The end of the wing which ultimately becomes the glue flap need not be trimmed to any particular shape except to provide a neat and unobtrusive glue area.

It is an object of the present invention to provide an improved food holder for handling an unusually shaped food product which will permit the consumer to hold the product safely in one hand for filling and eating.

Another object of the invention is to provide a food holder of the character described which provides increased sanitation and protection during filling and eating.

A further object of the invention is to provide a food holder of the character described which may be readily manufactured and shipped in a flat condition and then opened and stacked or nested at the point of use without occupying an excess of space.

An additional object of the present invention lies in the provision of integral locking means for the food holder to maintain the fold holder in an open condition.

Another object of the present invention is to provide a simple and inexpensive food holder which is convenient and safe to use.

Still other objects and advantages will readily occur to those skilled in the art upon reference to the following description and accompanying drawing.

DETAILED DESCRIPTION

Figure 1:
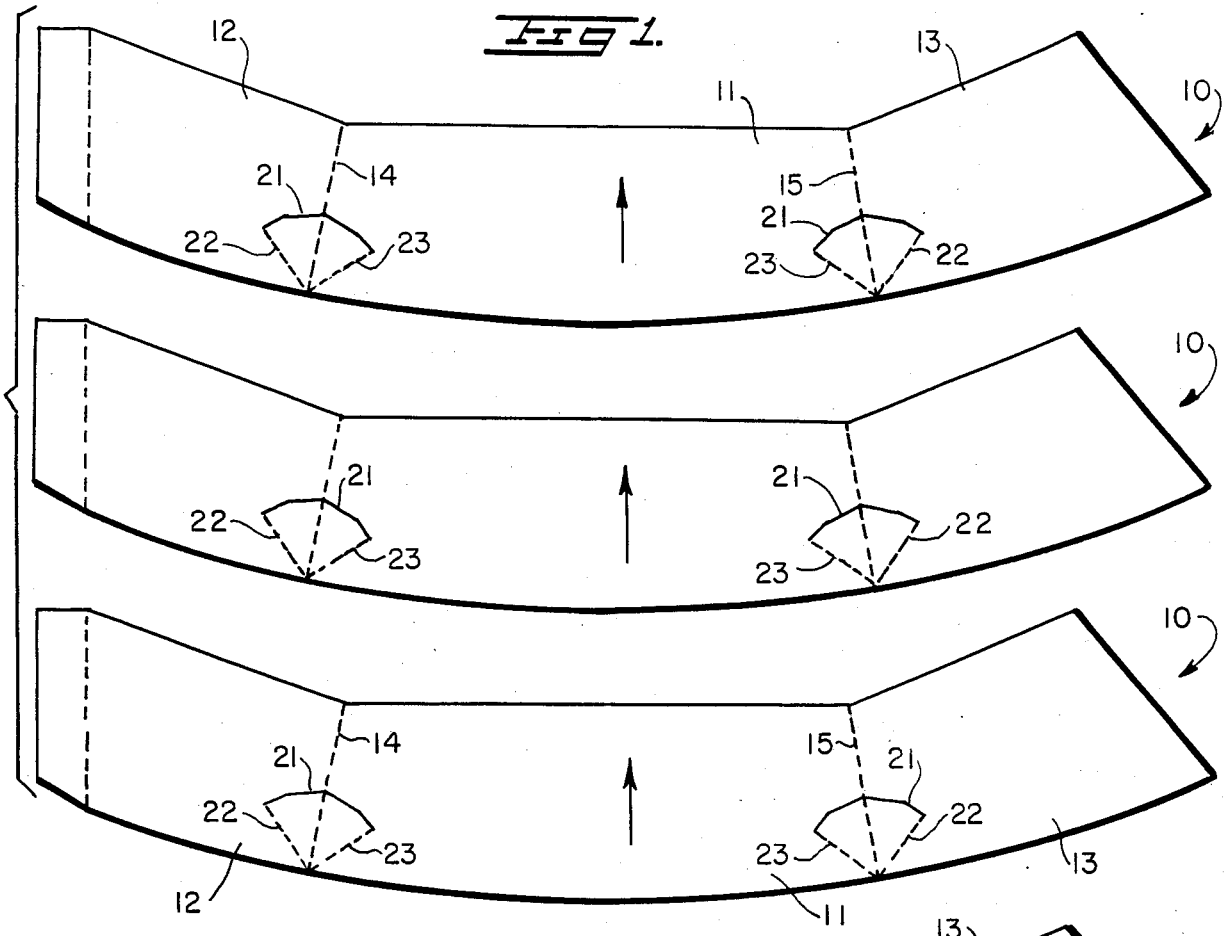
FIG. 1 illustrates a series of blanks for forming the food holder of the present invention showing the manufacturing sequence.

Referring more particularly to FIG. 1, a series of blanks 10 are shown for making food holders according to the present invention. The blanks are pre-cut and fed into a folding and gluing machine in the direction shown by the arrows on each blank. Each blank includes a main panel 11 located centrally thereof and a pair of wing portions or end panels 12, 13 foldably attached to the central portions by inclined score lines 14, 15. The bottom edges of the main panel 11 and wing portions 12, 13 are curved while the upper edges of the same panels are straight. The radius is the same for each panel so that the curved bottom edges of the connected panels is formed by a single arc. As an example, a radius of about 18 inches will yield an elliptically shaped food holder having a stable base wherein the major axis of the ellipse as measured at the base varies from about 4 to 7 inches. The end panels 12, 13 are cut so that they extend generally upward from the horizontal at about the same angle that the score lines 14, 15 are inclined from the vertical. Since the height of the wing elements is generally about the same as the height of the central panel and the curved bottom edge of each panel is formed by a single arc it is clear that both the bottom and top edges of each end panel will extend upwardly as disclosed. The angulated nature of the wing elements 12, 13 is required to produce a food holder having a base opening that is larger than the top opening. Meanwhile, the curved bottom edges of these panels assures that the bottom edges will be in the same plane when the food holder is opened to provide stability to the food holder. The blanks also include integral locking means 20 formed along the inclined score lines 14, 15 by cut lines 21 which extend equidistantly on each side of the score lines 14, 15 where they intersect score lines 22, 23 formed in panels 12, 13 and 11. The score lines 22, 23 are arranged at approximately 45 degree angles to the score lines 14, 15 to produce an included angle of about 90 degrees. In the preferred embodiment, the wing elements 12, 13 extend upwardly at an angle of about 20 degrees from the horizontal and the score lines 14, 15 are inclined inwardly from the vertical at an angle of about 20 degrees. This angulation may vary from between about 15 to 25 degrees. Moreover, when the blanks are run on a straight line gluer, the outer edge of wing element 12 must be oriented at a 90 degree angle to the base of the central portion 11.

Figure 2:
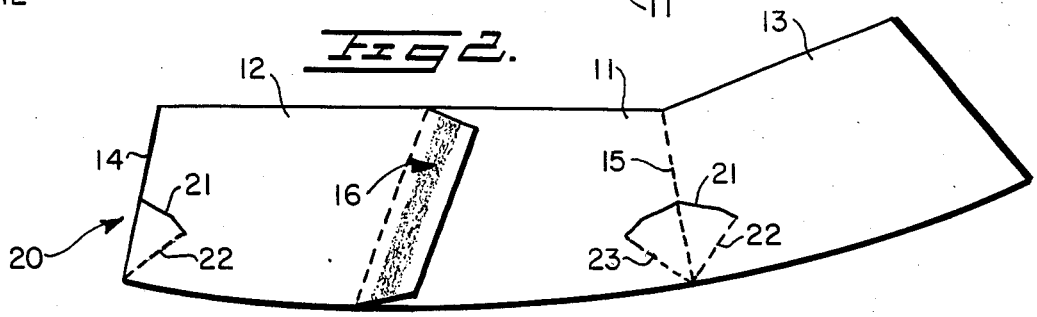
FIG. 2 shows a side view of a partially formed food holder with adhesive applied to one end.

FIG. 2 illustrates the first folding step in making the food holder of the present invention. For this purpose, wing element 12 is folded over about the score line 14 to lie on top of center panel 11 and expose the glue application at 16. Subsequently, in order to complete the food holder 17 as shown in FIG. 4, wing element 13 is folded about score line 15 to adhere the end of wing 12 to the end of wing 13.

Figure 3:
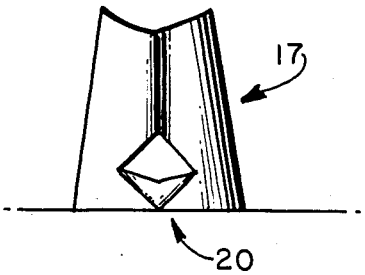
FIG. 3 is an end view of a fully formed food holder according to the present invention.
Figure 4:
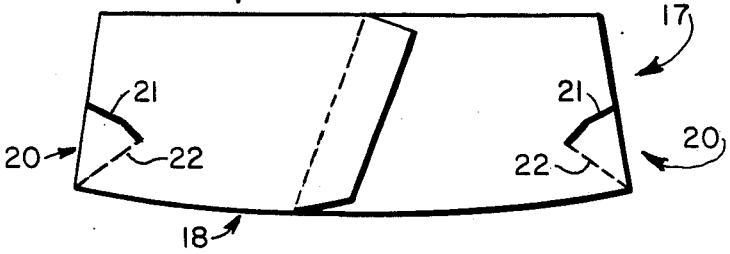
FIG. 4 is a side view of a fully formed food holder in its flattened condition according to the present invention.
Figure 5:
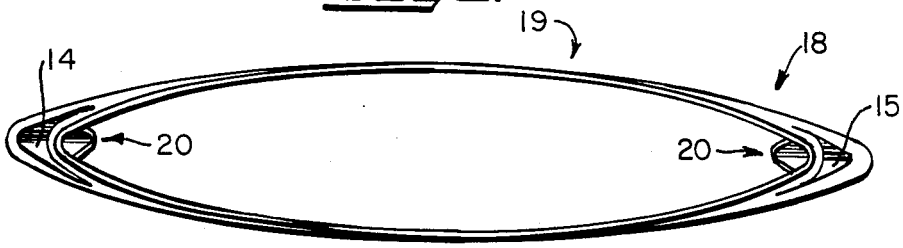
FIG. 5 is a top view of the food holder shown in FIGS. 3 and 4 in its open condition; and, FIG. 6 illustrates a food holder according to the present invention with a Pita bread sandwich supported in an upright condition.

The food holder device 17 shown in FIGS. 3–5 has a base opening 18 that is larger than the top opening 19 by virtue of the inclined orientation of the score lines 14 and 15. Moreover, because of the angulated orientation of the wing elements 12 and 13, the wing elements lie superimposed on the central panel 11 when the food holder is formed. When squared for use as shown in FIGS. 3 and 5, the food holder 17 assumes a substantially elliptical cross sectional configuration with converging or tapered ends formed by the score lines 14, 15. The curved bottom edges of the panels 11, 12 and 13 provide a flat, stable base for the food holder 17 when it is opened and the straight upper edges of the same panels assume a curved shape as shown in FIG. 3 when the food holder is opened. The food holder 17 is retained in its open condition by pushing the integral locking means 20 inwardly as shown in FIGS. 3, 5 and 6.

Figure 6:
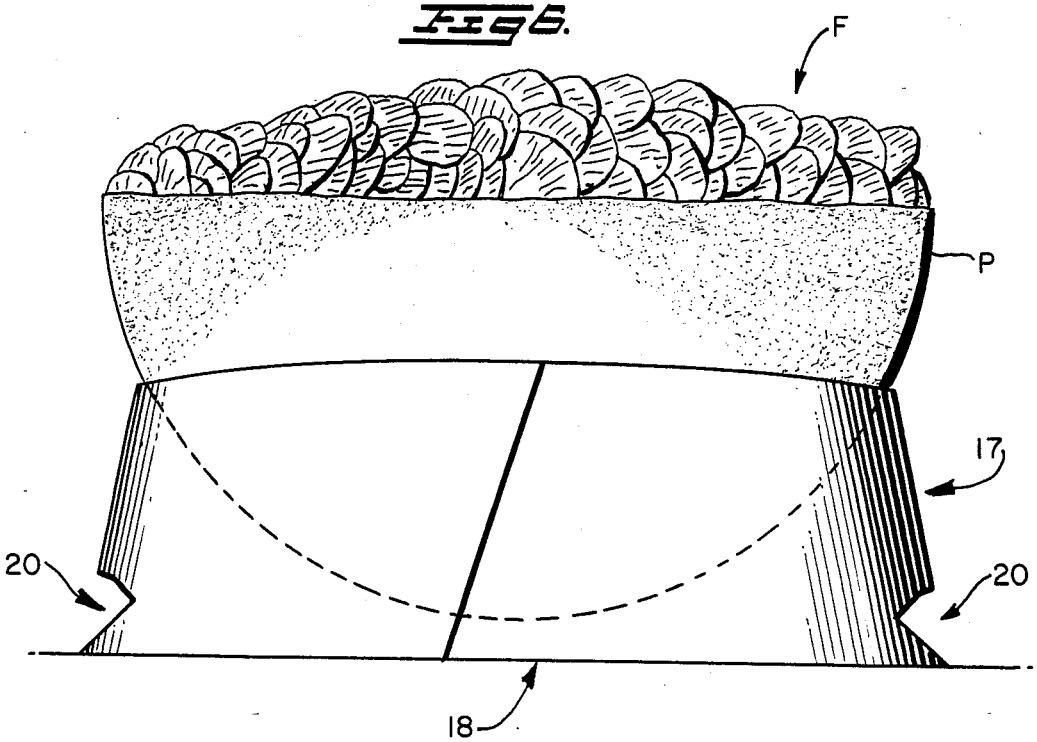

FIG. 6 illustrates the food holder 17 with a Pita bread sandwich P positioned in the elliptically shaped top opening 19 and filled with a filling material F. The food holder 17 is sized so as to support the Pita bread above the plane of bottom opening 18 and within the confines of the converging ends 14, 15. However, because of the substantially elliptical shape of the food holder 17, the enlarged base opening 18 and the curved bottom edges of the panels 11, 12 and 13, the sandwich is supported in a stable and secure manner. Of course, the food holder 17 also serves the dual purpose of providing the consumer with a means for holding the sandwich for convenient hand held consumption.

While only a single specific embodiment of the present invention has been shown and fully disclosed, it will be obvious to those skilled in the art that changes and modifications may be made without departing from the invention as defined in the appended claims.

What is claimed is:

1. A single blank for making a food holder capable of supporting a food product and prepared from foldable material comprising, an elongated central panel having two opposed ends, a top edge and a bottom edge, and a pair of integral end panels each having two opposed ends, top edges and bottom edges, the end panels extending outwardly and upwardly with respect to the central panel and each end panel having one free end and one end joined to the central panel along upwardly converging score fold lines, the combined length of the end panels being slightly greater than the length of said central panel between its two opposed ends with one free end of one of said end panels being shaped to provide a glue area for adherence to the free end of the other end panel, said score lines being inclined upwardly and inwardly with respect to one another and at the same angular relationship with respect to the vertical, said central panel and end panels each being of about the same height with straight top edges and curved bottom edges, said bottom edges being formed by a single arc of constant radius, and said top edges being arranged so that the top edges of said end panels are each inclined upwardly and outwardly from the top edge of said central panel at the same angular relationship with respect to one another and with respect to the horizontal, as the angular relation of said inclined score lines from the vertical, said blank forming a sleeve with an elliptical cross section when the end panels are overlapped and adhered together with converging ends formed by the inclined score lines and with a bottom opening and a smaller top opening dimensioned such that a food product is supportable on said top edges.

2. The blank of claim 1 including integral locking means comprising, a pair of generally circular cut lines bisected by each respective inclined score line with ends that extend equidistantly into each adjacent panel, wherein the ends intersect paired score lines which begin at the inclined score lines near the bottom edge of the panels at an included angle of about 90 degrees.

3. The blank of claim 2 wherein the angular relationship of said inclined score lines from the vertical and the top edges of the end panels from the horizontal is from about 15–25 degrees.

4. The blank of claim 3 wherein the angular relationship of said inclined score lines from the vertical and the top edges of said end panels from the horizontal is 20 degrees.

5. A food holder made from the blank of claim 1 comprising, a sleeve having an open top and bottom that is normally disposed in a flattened condition prior to use but which may be opened and locked in its open position for use to assume a generally elliptical cross sectional shape where the top opening is smaller than the bottom opening, said sleeve comprising two side wall panels with opposed ends formed by said inclined score lines with one side wall panel formed by said blank central panel and the other side wall panel formed by said pair of blank end panels with said overlapped free ends adhered together, the side walls having top edges and bottom edges having substantially the same size and shape, and joined at their ends along corners which are inclined inwardly and upwardly with respect to one another and at the same general angle with respect to the vertical, and a locking means for said sleeve comprising tabs cut from equal portions of said side wall at the inclined corners which are folded inside the side walls to lock the sleeve in its open condition.

6. The food holder of claim 5 wherein the locking means are formed by generally circular cut lines located at each inclined corner with ends that extend equidistantly into each adjacent side wall wherein the ends intersect paired score lines in each side wall which begin at the corner near the bottom edge of the sleeve and include an angle of about 90 degrees.

* * * * *